US005663714A

United States Patent [19]

Fray

[11] Patent Number: 5,663,714

[45] Date of Patent: Sep. 2, 1997

[54] WARNING SYSTEM FOR GIVING VERBAL INSTRUCTION DURING FIRE AND METHOD OF OPERATING THE WARNING SYSTEM

[76] Inventor: Eddie Lee Fray, 124 Majors Rd., Pensacola, Fla. 32503

[21] Appl. No.: 432,516

[22] Filed: May 1, 1995

[51] Int. Cl.[6] ..... G08B 25/08

[52] U.S. Cl. ..... 340/692; 340/326; 340/628; 340/691

[58] Field of Search ..... 340/692, 691, 340/693, 628–630, 584, 326

[56] References Cited

U.S. PATENT DOCUMENTS

| | | | |
|---|---|---|---|
| 4,107,464 | 8/1978 | Lynch et al. | 340/692 X |
| 4,531,114 | 7/1985 | Topol et al. | 340/628 X |
| 4,682,348 | 7/1987 | Dawson et al. | 340/692 X |
| 4,754,266 | 6/1988 | Shand et al. | 340/692 X |
| 4,816,809 | 3/1989 | Kim | 340/692 |
| 5,291,183 | 3/1994 | Chiang | 340/692 X |
| 5,307,051 | 4/1994 | Sedlmayr | 340/692 X |

*Primary Examiner*—Thomas Mullen
*Attorney, Agent, or Firm*—Maryam Bani-Jamali

[57] ABSTRACT

An alarm system, comprising a smoke detector, a smoke detector output relay, a recording switch, a microphone, a digital recording and a play back device, a timer/pulse generator, a pulse counter, a number of speakers, an amplifier and an alarm tone generator, and the method of operation of the alarm system are presented. The smoke detector output relay activates a printed circuit that is powered off the smoke detector at two different points. The recording switch, when activated, allows a voice message to be recorded through the microphone on a digital recording and play back device. The timer/pulse generator starts when activated by the smoke detector output relay. The timer/pulse generator then sends timed pulses to the pulse counter that controls output of the digital recording and play back device, i.e. a verbal message, and of the alarm tone generator. The controlled output of the digital recording and play back device and of the alarm tone generator is then sent to the amplifier. Then, the output of the amplifier is sent to the number of speakers which send messages and tones, alerting by standing individuals of presence of fire or smoke. The messages and tones may be repeated until the alarm system is reset.

14 Claims, 5 Drawing Sheets

WARNING SYSTEM FOR GIVING VERBAL INSTRUCTION DURING FIRE AND METHOD OF OPERATING THE WARNING SYSTEM

BACKGROUND OF THE INVENTION

I. Field of Invention

The present invention relates to a warning system that warns individuals of presence of smoke and fire and provides verbal instructions of escape. A method of operating said warning system is also provided. The warning system is particularly designed for providing talking instructions to children for escaping fires and dangerous situations, thus being termed a "talk-alert".

II. Brief Description of the Art

Despite existence of numerous types of fire detectors and smoke detectors, individuals are regularly caught in and injured in outbursts of fires. A large number of said injured individuals are children who are left without instruction of escape. An in-depth search of prior art has located the following patents which were distinguishable from the present invention.

Hundreds of patents have been reviewed. A majority of said patents describe an audible signaling system, but do not provide verbal instructions for individuals caught in fire to follow. A few recently issued patents include some similarity to the present invention by providing a speaking device. For example, U.S. Pat. No. 5,291,183 to Chiang describes a multi-functional alarming system which employs a vocoder enabling the alarm system to emit not only a buzzing sound but also a human voice. Yet, major differences exist in the components of the multi-functional alarming system of Chiang and the alarm system of the present invention. The present alarm system uses an amplifier and a digital recording and play back device, as well as a pulse counter and a timer/pulse generator. Chiang's multi-functional alarming system deletes the digital recording and play back device and neither uses a timer/pulse generator nor a pulse counter while using a vocoder, a memory, a preamplifier and a power amplifier.

U.S. Pat. No. 5,307,051 to Sedlmayr patents a night light apparatus and method for altering the environment of a room. Said patent points on an apparatus including a means for detecting smoke or fire or both smoke and fire and for generating a signal in response thereto and a means for furnishing audible information for instructing a child in the course of fire. However, Sedlmayr does not in detail provide the structure of the smoke or fire or both smoke and fire detecting means of the apparatus, as will be provided below. Sedlmayr notes that said detecting means includes a microphone, a digital recording and play back device, a programmable read-only memory card and an amplifier. The relationship of each component to other components and the location of each component is not specifically stated or shown in a chart or diagram. In addition, there is no reference to a timer/pulse generator or a pulse counter.

U.S. Pat. No. 4,816,809 to Kim describes a speaking fire alarm system, as well. However, Kim uses a temperature sensor and a comparator to initiate an alarm. The present alarm system, on the other hand, uses a smoke detector without using a comparator.

Although existing fire detectors and smoke detectors are known that detect presence of fire or smoke or both fu:e and smoke and provide audible alarms, said detectors lack certain advantages of the present alarm system. It would be desirable to provide an alarm system that provides programmable customized messages with a digital recording and playback device, using a smoke detector output relay and a speaker, at minimal expenses, using a pulse counter and a timer/pulse generator, and specifically designed for providing verbal instructions for children during cases of emergency.

SUMMARY OF THE INVENTION

To meet the need for a warning system which is capable of providing verbal instructions in cases of fire or smoke and which is capable of being produced at minimal expenses, the present invention comprises an alarm system for guiding individuals, particularly children, away from danger. The alarm system comprises a smoke detector, a smoke detector output relay, a recording switch, a microphone, a digital recording and a play back device, a timer/pulse generator, a pulse counter, a number of speakers, an amplifier and an alarm tone generator. The smoke detector output relay activates a printed circuit that is powered off the smoke detector at two different points. The recording switch, when activated, allows a voice message to be recorded through the microphone on a digital recording and play back device. The timer/pulse generator starts when activated by the smoke detector output relay. The timer/pulse generator then sends timed pulses to the pulse counter that controls output of the digital recording and play back device, i.e. a verbal message, and of the alarm tone generator. The controlled output of the digital recording and play back device and of the alarm tone generator is then sent to the amplifier. Then, the output of the amplifier is sent to the number of speakers which send messages and tones, alerting by standing individuals of presence of fire or smoke. The messages and tones may be repeated until the alarm system is reset. A resetter may be used to reset the timer/pulse generator. In addition, a number of voltage controllers may be used.

Therefore, it is an object of this invention to provide to individuals, particularly children, an alarm system which can emit easily changeable verbal instructions and alternate voices upon smoke detection. Individuals, especially younger children, can be taught to cope with different situations accordingly upon replay of different instructions. By using the digital recording and play back device, said instructions may be easily and economically changed regularly, before, during and after emergency situations.

These and other objects of the invention will become apparent to one skilled in the art from inspection of the drawings and the accompanying detailed description. It will, of course, be understood that the invention is not limited to the particular preferred embodiment illustrated in the accompanying drawings and described in detail below, and the additional embodiments within the scope and spirit of the invention will be readily apparent.

DESCRIPTION OF THE PREFERRED EMBODIMENT

Figure 1:
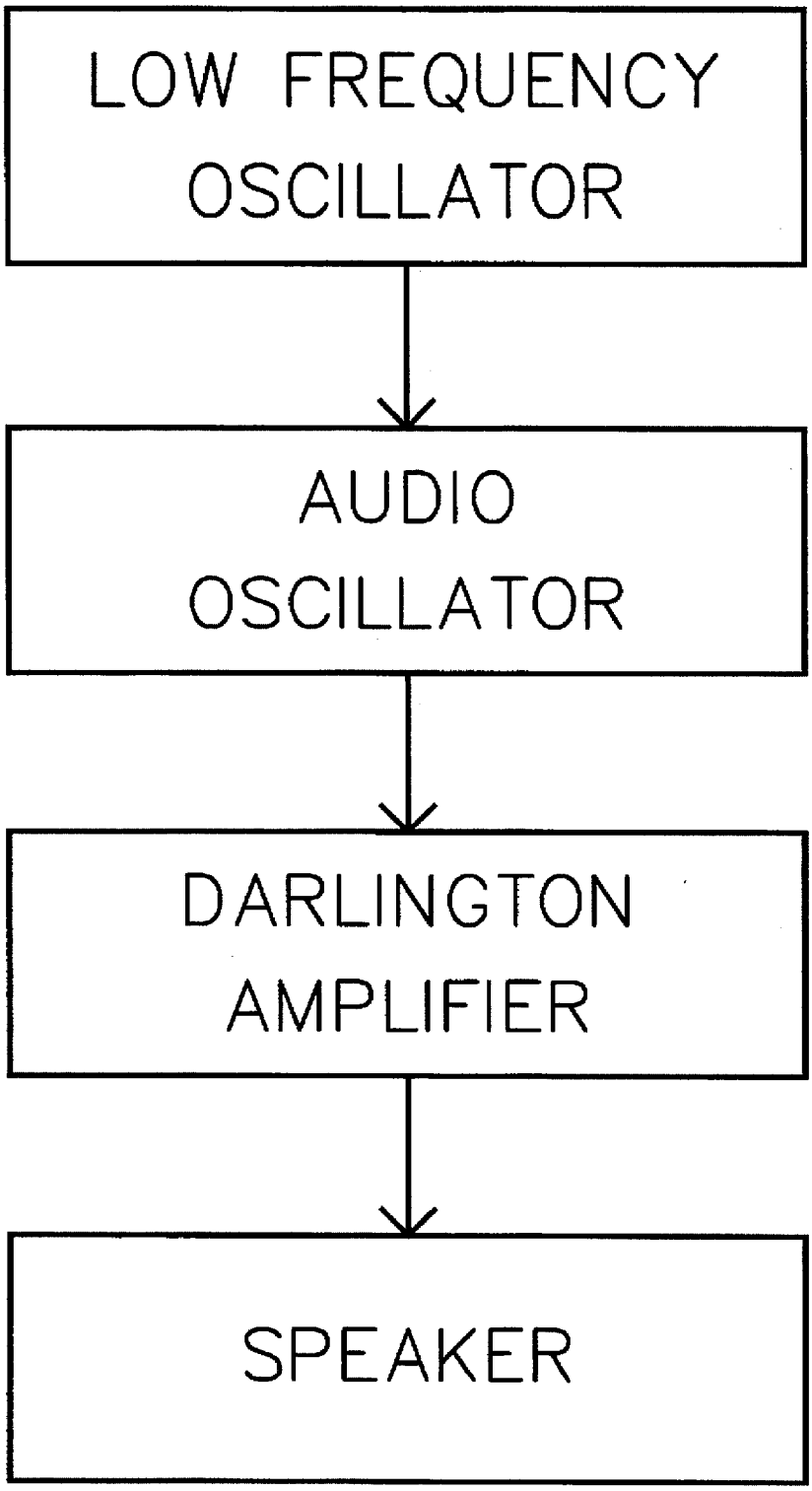
FIG. 1 (PRIOR ART)
FIG. 1 is a block diagram of a conventional alarm system of the prior art.

In the present invention, an alarm system 20 is described which comprises a microphone 6, a recording switch 5, a digital recording and play back device 7, a timer/pulse generator 8, a pulse counter 9, a number of speakers 12, an amplifier 11, an alarm tone generator 10, a smoke detector 13 and a smoke detector output relay 1. For ease of description, the mechanical and electrical details of the preferred embodiment are presented in separate sections below.

Mechanical Portion

A warning system is provided which is capable of providing verbal instructions in cases of emergency situations, comprising fire or smoke hazards. Said warning system has an alarm system 20 for guiding individuals caught in emergency situations away from hazards. Said alarm system 20 comprises several significant components. A smoke detector 13 is connected to a first point of a powered source and to a second point of said powered source, at a Point A, represented by 3, and a Point B, represented by 4, respectively. A printed circuit 2 is connected to the smoke detector 13. A smoke detector output relay 1 is connected to the printed circuit 2 from a side which is easily exposable to smoke upon commencement of and during emergency situations. A recording switch 5 is attached to the printed circuit 2 at a point that is easily reachable by an individual for changing verbal instructions of the alarm system 20 used for emergency situations. A microphone 6 is connected to the printed circuit 2 at a reachable position in case a magnification of a live provision of verbal instructions is needed during emergency situations. A digital recording and a play back device 7 are located close to the recording switch 5 and to the microphone 6. A timer/pulse generator 8 is located adjacent to the digital recording and the play back device 7. A pulse counter 9 is proximate to the timer/pulse generator 8 in order to minimize time delay between sending of pulses by the timer/pulse generator 8 and receipt of pulses by the pulse counter 9. An alarm tone generator 10 is used for generating alarm tones and is located proximate to the pulse counter 9. An amplifier 11 is placed adjacent to the timer/pulse generator 8 and to the digital recording and play back device 7 such that controlled output of the digital recording and play back device 7 and of the alarm tone generator 10 is sent to the amplifier 11. A number of speakers 12 are used which are capable of emitting clear, high-pitched loud acoustical signals and verbal messages and which are located adjacent to the amplifier 11 such that the output of the amplifier 11 is sent to the number of speakers 12. Thus, upon application of said alarm system 20, sound waves are produced by the number of speakers 12 that are intended to be louder than high ambient sound levels which surround individuals in emergency situations.

The microphone 6, the digital recording and play back device 7, the number of speakers 12, the amplifier 11, the smoke detector 13, the smoke detector output relay 1, the pulse counter 9 and the timer/pulse generator 8 of a preferred embodiment of the alarm system 20 are sized and arranged to form a portable enclosure of approximately 7½ in. in width, approximately 7½ in. in length and approximately 2 in. in depth. The sizes of the components of the enclosure of the alarm system 20 may be decreased or increased in order to reduce or enlarge the size of the enclosure, as required. A miniaturized enclosure can be carried from room to room and moved to different locations. An enclosure having a depth of approximately 7½ in. may be more convenient for some purposes, for example to include a larger speaker 12. In addition, the enclosure containing the components of the alarm system 20 could be attached to a wall, preferably at a height, where the enclosure of the components of the alarm system 20 is out of reach of children while being in a location to be easily adjustable by adults. Since the microphone 6 is switched on and off by the recording switch 5, the microphone 6 and recording switch 5 should always be in a position to facilitate recording of messages by turning the recording switch 5 on and off. In addition, the number of speakers 12 should be placed such that messages and tones are heard clearly during fires and emergencies. It is preferable that there is a certain amount of distance between the individual and the alarm system 20, thereby reducing direct and damaging exposure of the individual to relatively loud messages and tones generated by the alarm system 20.

Any type of speaker that emits clear, high-pitched loud acoustical signals and verbal messages could be used. Sound waves produced by the number of speakers 12 are specifically intended to be louder than the high ambient sound levels that may occasionally surround the individual who is using the alarm system 20, especially in fires and other emergencies. The sound that the number of speakers 12 emits is pulsating and high-pitched in character to attract maximum attention from the user because it is believed that pulsating high-pitched sounds are more effective for this purpose than sounds presented in a continuous manner. In addition, verbal messages fill gaps of pulsating sounds to instruct the individual to take necessary courses of action during fire, smoke and other similar emergencies.

In another version of the alarm system 20, a flashlight 17 is provided which comprises two or more light emitting diodes (LEDs) 21. A high intensity light bulb 22 may be used as well. (Please refer to FIG. 5.) The flashlight 17 provides a visual alarm that starts operating upon activation of the number of speakers 12 in order to alert the user in dark or smoky environments, such as in a bedroom filled with smoke or in cases where acoustical alarm and message of the number of speakers 12 alone are insufficient to alarm the individual. The size of the flashlight 17 is selected in order to facilitate the inclusion of the flashlight 17 as a part of the enclosure of the components of the alarm system 20. The flashlight 17 may be positioned on different parts of the enclosure of the components of the alarm system 20, either on a front surface or on any of lateral sides of the enclosure, depending upon the position of the enclosure with respect to the individual who is to be warned in case of smoke or other similar emergency. However, if the enclosure of the components of the alarm system 20 is attached to the ceiling, placement of the flashlight 17 on the front surface of the enclosure may be more advantageous and more beneficial in a dark or smoky environment. A battery compartment 18 may be necessary and must be easily accessible for replacement of one or more batteries by removing cover of the battery compartment 18.

Figure 2:
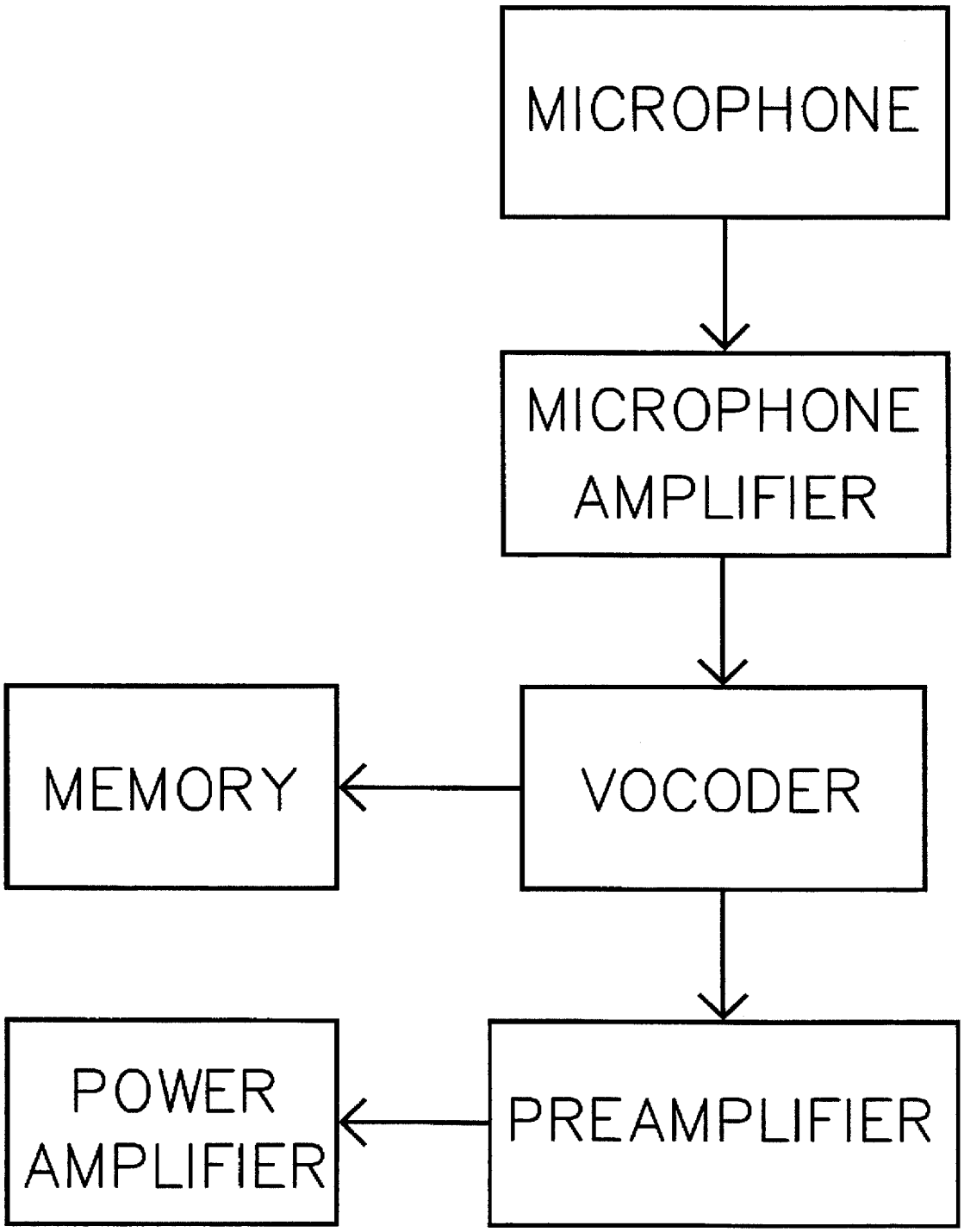
FIG. 2 (PRIOR ART)
FIG. 2 is a block diagram of a speaking alarm system described in U.S. Pat. No. 5,291,183.
Figure 3:
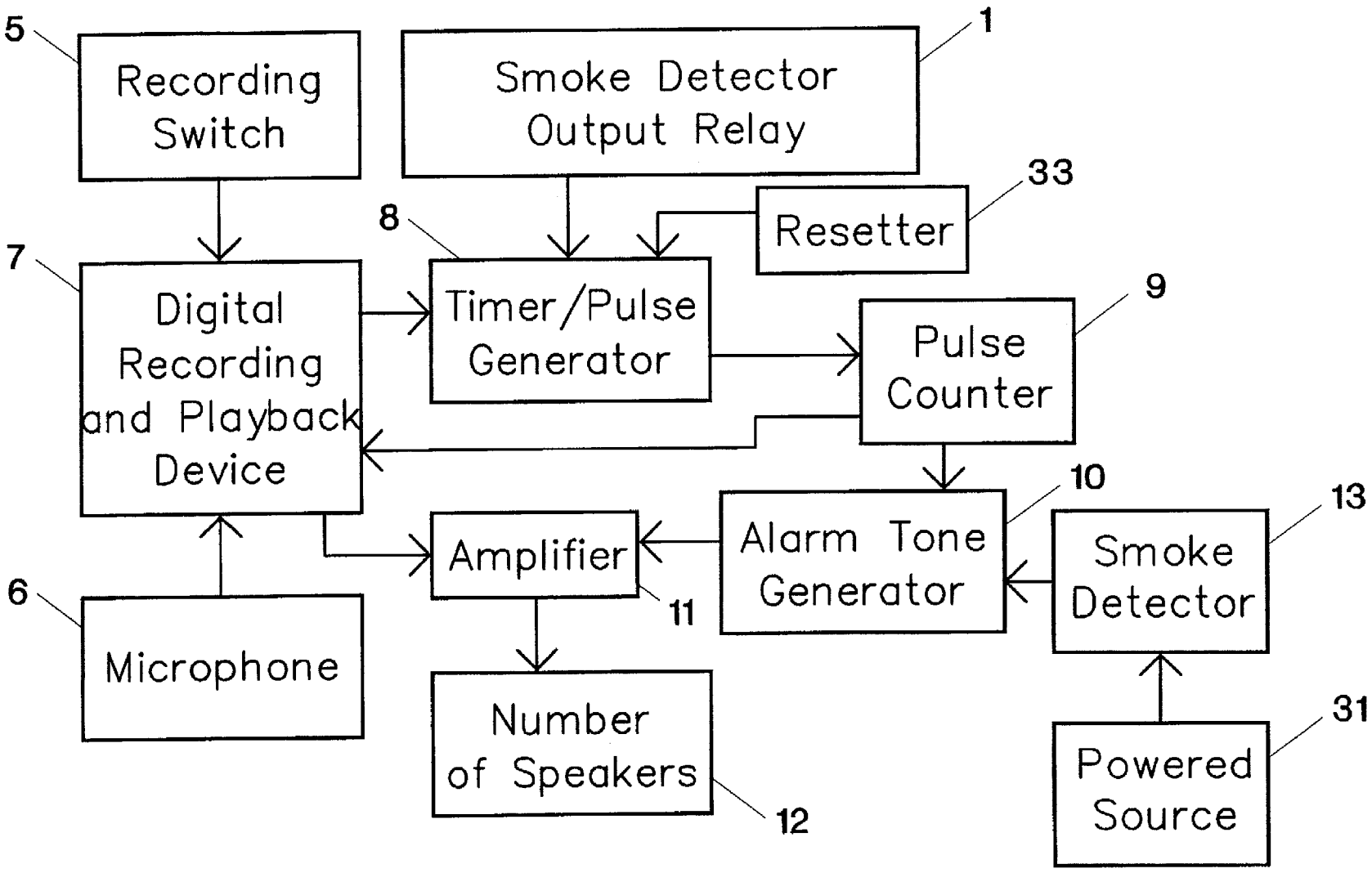
FIG. 3 is a block diagram of a preferred embodiment of an improved alarm system.

As described above, the alarm system 20 is distinguishable from conventional alarm systems and from a recently patented multi-functional alarming system. The conventional alarm systems are simply designed with a buzzing function in order to emit loud noises or buzzing functions when activated, failing to create verbal instructions. As demonstrated in FIG. 1 in a block diagram of a conventional alarm system, a preferred embodiment of a conventional alarm system comprises a low frequency oscillator, an audio oscillator, a Darlington amplifier and a speaker. As shown in FIG. 2 in a block diagram of a recently patented multi-functional alarming system, the recently patented multi-functional alarming system comprises a microphone, a microphone amplifier, a vocoder, a memory; a preamplifier and a power amplifier. A comparison of the block diagrams in FIG. 1 and in FIG. 2 with the block diagram in FIG. 3 of the alarm system 20 of the present invention indicates differences among the three block diagrams.

Electronic Portion

Figure 4:
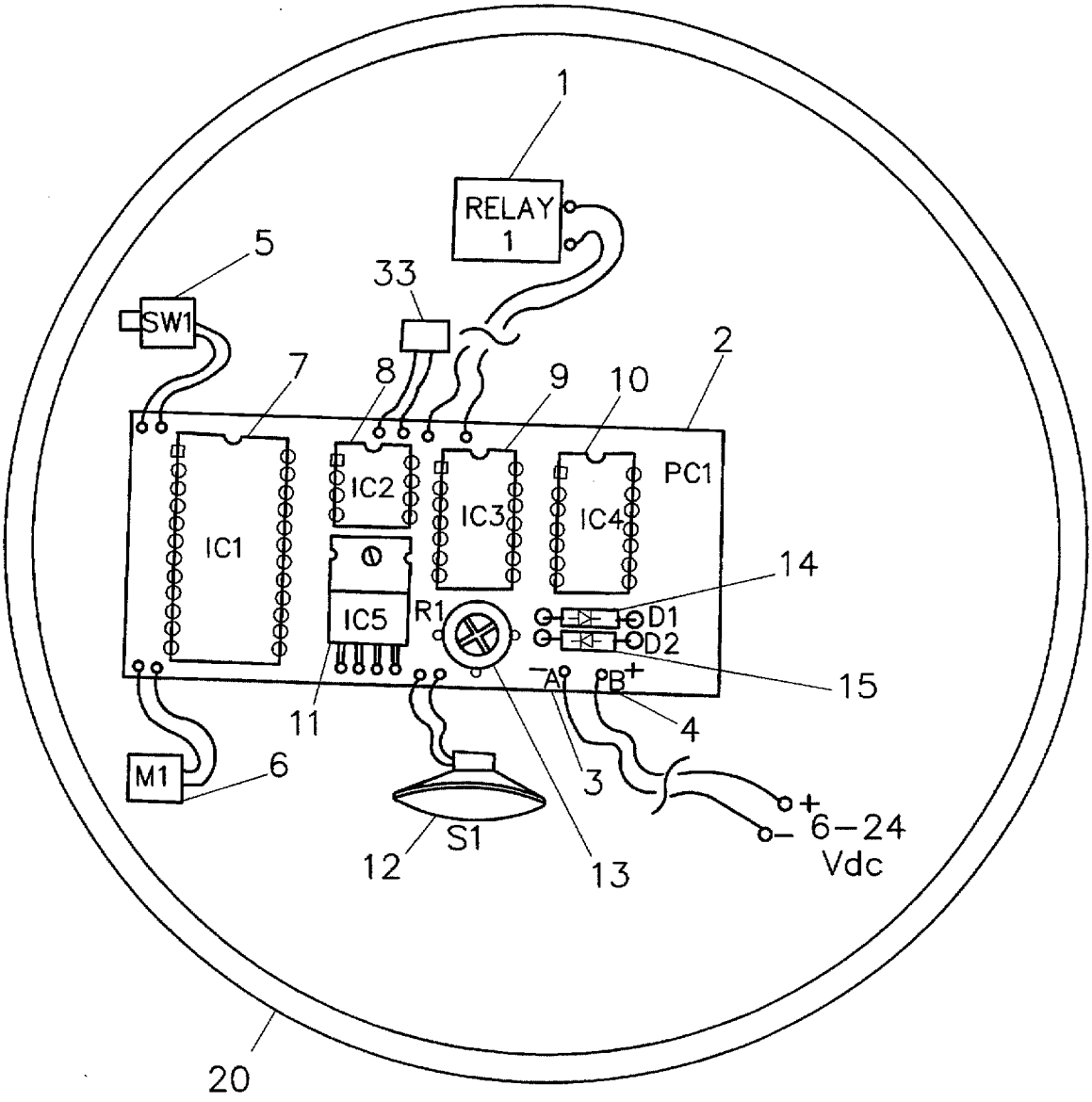
FIG. 4 is a circuit diagram of a preferred embodiment of an improved alarm system.

FIG. 4 is an electrical diagram of the preferred embodiment of the alarm system 20. The electronic circuit which resides in the enclosure is on a printed circuit board and is connected to a battery which is put in series with the on/off switch to activate the circuitry.

The smoke detector output relay 1 activates the printed circuit 2 that is powered off the smoke detector 13 at two different points, a first point and a second point, i.e. Point A represented by 3 and Point B represented by 4, ranging from approximately 6 Vdc to approximately 24 Vdc.

The recording switch 5, when activated, allows a message to be recorded, through the microphone 6, on the digital recording and play back device 7. The message can be a combination of verbal and tone messages. When activated by the smoke detector output relay 1, the timer/pulse generator 8 starts functioning. When activated, the timer/pulse generator 8 sends timed pulses to the pulse counter 9 that controls output of the digital recording and play back device 7, i.e. a verbal message, and of the alarm tone generator 10. The controlled output of the digital recording and play back device 7 and the alarm tone generator 10 is then sent to the amplifier 11. The amplifier 11 is preferably 20 watts. Then, the output of the amplifier 11, which is preferably 20 watts, is sent to the number of speakers 12 which send messages and tones, alerting by standing individuals of presence of fires or smoke. The messages and tones are presented in a pattern, said pattern most preferably being a number of tones or alarms, followed by a verbal message, followed by the same number of tones. The pattern may be adjusted and changed easily. The messages and tones may be repeated until the alarm system 20 is reset. A resetter 33 may be used to reset the timer/pulse generator 8. In addition, a number of voltage controllers may be used.

The amplifier 11 is preferably 20 watts or any other magnitude suitable for the present application. The preferred embodiment can operate using a number of batteries ranging from about 6 Vdc to about 24 Vdc. Several voltages are required to be derived from the existing number of batteries. These voltages are controlled by voltage controllers 14 and 15. "Bat+" is the full battery voltage, which serves purposes comprising powering the alarm tone generator 10.

The alarm system 20 could be optionally provided with additional electronic circuitry allowing the alarm signal to be transmitted through cable or by means of wireless transmission and receivers to another physical location.

The amplifier 11 is selected to provide enough amplification of an input sent to the amplifier 11, said input being a combination of verbal and sound messages sent from the digital record and playback device 7 and of the alarm tone generator 10. Deletion of preamplifiers in said alarm system 20 lowers manufacturing costs. After amplification by the amplifiers 11, the amplified output is then fed into the number of speakers 12, thereby making it possible to provide an alarm when the smoke detector 13 detects smoke at any one of several locations where the smoke detector 13 may be placed around the alarm system 20.

Figure 5:
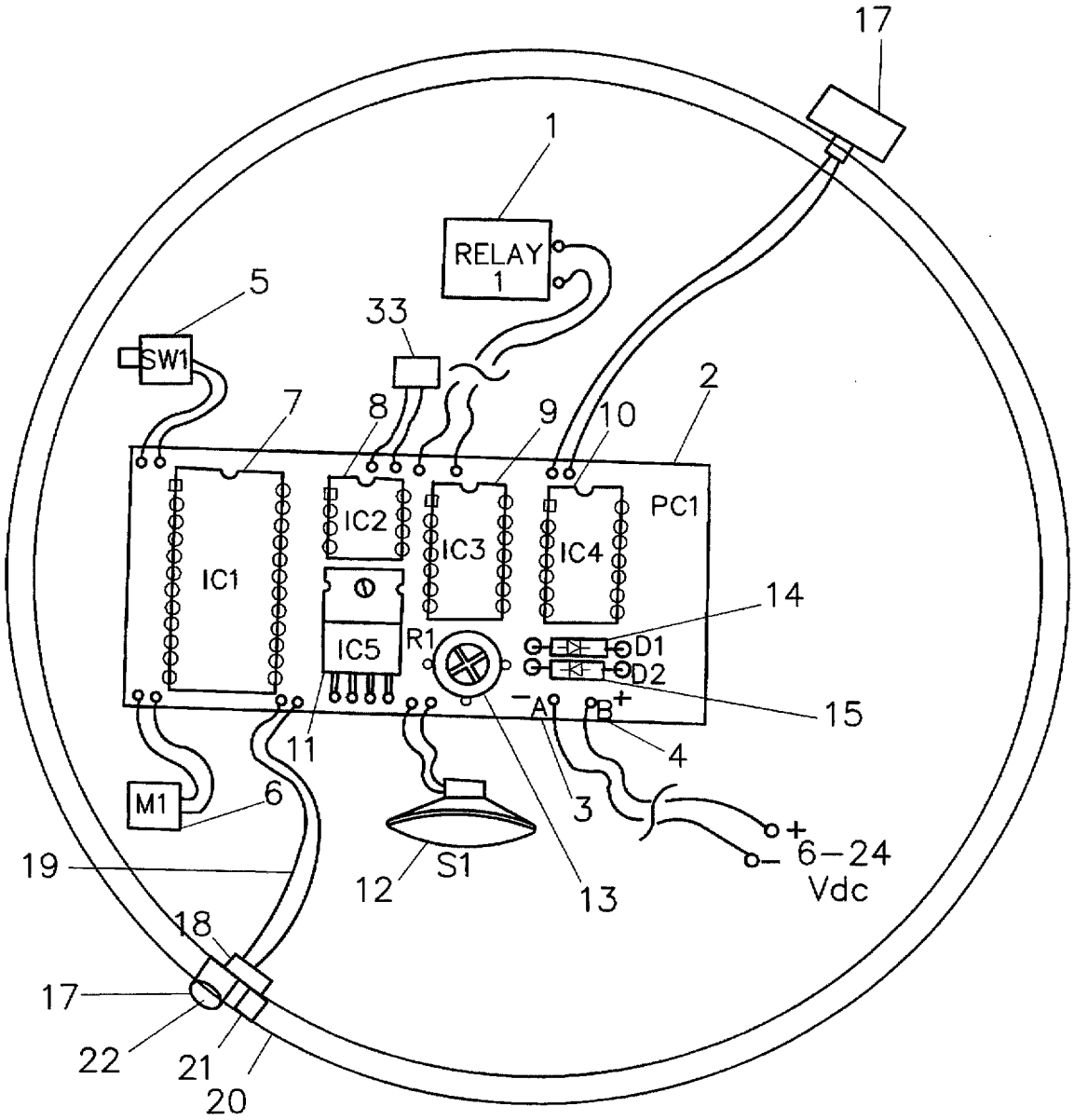
FIG. 5 is a circuit diagram of a version of an improved alarm system.

Another version of the alarm system 20 uses two or more parallel light emitting diodes 21 containing integral flashing circuitry 19 (as shown in FIG. 5). These LEDs 21 are put in series with the number of speakers 12, which emit verbal messages followed by alerting tones repetitively. A high-intensity light bulb 22 may be used as well. The use of the specified LEDs 21, the light bulb 22 and the number of speakers 12 reduces the need for external components to generate a high-pitched buzzing noise. When the number of speakers 12 is turned on, the LEDs 21 and the light bulb 22 are turned on simultaneously.

A combination of pulsed alerting sounds and verbal messages is preferable because said combination of sounds and verbal messages is believed to have a more effective alerting effect on the individual than a continuous sound has. A sound produced by a buzzer may create horror and confusion in case of emergency, especially for younger children and older adults. However, a combination of pulsed alerting sounds and verbal messages may decrease some of the existing horror and may provide a guide for said children and elderly during the fire or emergency, indicating path of escape. Said verbal messages may be personalized and regularly changed and recorded to satisfy the needs of the individuals during fire, smoke and other emergencies in commercial and residential areas. The personalized, verbal messages of the alarm system 20 make the alarm system 20 a more efficient means for guiding individuals, especially children and elderly, during moments of horror and confusion away from scenes of danger and into safety.

The types of electrical components used make it possible for many of the components to be integrated into a single chip. Alternately, or in addition to such integration, surface-mount components could be used to produce a minimized device. Moreover, the alarm system 20 is relatively economical due to deletion of certain components of other existing systems and is cheaper to build. The alarm system 20 includes simple elements. Another advantage of the device is that additional components may be added, including flashlights 17, thus simultaneously lightening path of escape for the individual caught in darkness of smoke.

Certain objects are set forth above and made apparent from the foregoing description and figures. However, since certain changes may be made in the above description and figures without departing from the scope of the invention, it is intended that all matters contained in the foregoing description and figures shall be interpreted as illustrative only of the principles of the invention and not in a limiting sense. With respect to the above description and figures then, it is to be realized that any descriptions and figures deemed readily apparent and obvious to one skilled in the art and all equivalent relationships to those stated in the figures and described in the specification are intended to be encompassed by the present invention.

Further, since numerous modifications and changes will readily occur to those skilled in the art, it is not desired to limit the invention to the exact construction and operation shown and described, and accordingly, all suitable modifications and equivalents may be resorted to, falling within the scope of the invention. It is also to be understood that the following claims are intended to cover all of the generic and specific features of the invention herein described, and all statements of the scope of the invention which, as a matter of language, might be said to fall therebetween.

What is claimed is:

1. A warning system capable of providing verbal instructions in cases of emergency situations, comprising fire or smoke hazards, said warning system having an alarm system for guiding individuals caught in emergency situations away from hazards, said alarm system comprising:

a. a smoke detector connected to a first point of a powered source and to a second point of said powered source;

b. a printed circuit connected to the smoke detector;

c. a smoke detector output relay connected to the printed circuit from a side which is easily exposable to smoke upon commencement of and during emergency situations;

d. a recording switch connected to the printed circuit at a point that is easily reachable by an individual for changing verbal instructions of the alarm system used for emergency situations;

e. a microphone connected to the printed circuit;

f. a digital recording and a play back device located close to the recording switch and to the microphone;

g. a timer/pulse generator located adjacent to the digital recording and the play back device;

h. a pulse counter located proximate to the timer/pulse generator in order to minimize time delay between sending of pulses by the timer/pulse generator and receipt of pulses by the pulse counter;

i. an alarm tone generator for generating alarm tones and being located proximate to the pulse counter;

j. an amplifier located adjacent to the timer/pulse generator axial to the digital recording and the play back device such that controlled output of the digital recording and the play back device and of the alarm tone generator is sent to the amplifier; and k. a number of speakers which are capable of emitting clear, high-pitched loud acoustical signals and verbal messages, said number of speakers located adjacent to the amplifier such that the output of the amplifier is sent to the number of speakers;

wherein sound waves produced by the number of speakers are intended to be louder than high ambient sound levels that surround individuals in emergency situations.

2. The warning system capable of providing verbal instructions in cases of emergency situations as claimed in claim 1, wherein the output of the amplifier is approximately 20 watts.

3. The warning system capable of providing verbal instructions in cases of emergency situations as claimed in claim 1, wherein the alarm tone generator generates a pattern comprising a number of tones and alarms, followed by a verbal message, followed by an equivalent number of tones, said pattern being capable of being adjusted and changed prior to, during and following emergency situations.

4. The warning system capable of providing verbal instructions in cases of emergency situations as claimed in claim 1, wherein the microphone, the digital recording and play back device, the number of speakers, the amplifier, the smoke detector and the smoke detector output relay, the pulse counter and the timer/pulse generator are sized and arranged to form a portable enclosure of approximately 7½ in. in length, approximately 7½ in. in width and approximately 7½ in. in depth.

5. The warning system capable of providing verbal instructions in cases of emergency situations as claimed in claim 1, wherein the warning system is attached to a surface of a wall, such that messages and tones are heard clearly during emergency situations.

6. The warning system capable of providing verbal instructions in cases of emergency situations as claimed in claim 1, wherein the warning system also includes a flashlight comprising:

a. a number of parallel light emitting diodes placed in series with the number of speakers;

b. a battery compartment connected to the number of parallel light emitting diodes; and c. integral flashing electronic circuitry comprising a cable to transmit alarm signals to a physical location, with the flashlight being positioned on any selected part of an enclosure including components of the alarm system, depending upon the position of the enclosure of the components of the alarm system in a room;

such that each speaker emits verbal messages followed by pulsed, alerting tones repetitively and is turned on automatically and immediately when the light emitting diodes are turned on.

7. The warning system as claimed in claim 6, wherein the flashlight has a high intensity light bulb.

8. The warning system as claimed in claim 6, wherein batteries of the battery compartment are connected to the integral flashing electronic circuitry in series, have a voltage ranging from about 6 Vdc to about 24 Vdc and are controlled by voltage controllers.

9. A method of operating a warning system capable of providing verbal instructions in cases of emergency situations, including fire or smoke hazards, said method comprising:

a. detecting smoke using a smoke detector;

b. activating a printed circuit that is powered off the smoke detector at a first point of a powered source and at a second point of said powered source, said first point and said second point ranging from approximately 6 Vdc to approximately 24 Vdc, using a smoke detector output relay;

c. allowing a voice message to be recorded when a recording switch connected to the printed circuit is activated;

d. magnifying the voice message using a microphone;

e. recording the voice message using a digital recording and a play back device;

f. activating a timer/pulse generator by the smoke detector output relay;

g. sending timed pulses to a pulse counter by the timer/pulse generator, said pulse counter simultaneously controlling output of the digital recording and play back device, said controlled output comprising verbal messages;

h. controlling by the pulse counter the controlled output of an alarm tone generator;

i. receiving the controlled output of the digital recording and play back device and of the alarm tone generator by an amplifier; and j. sending messages and tones by a number of speakers which receive the controlled output of said amplifier in order to alert by standing individuals of presence of emergency situations;

such that the messages and tones sent by the number of speakers are repeated and are presented in a pattern until the alarm system is reset.

10. The method of operating the warning system capable of providing verbal instructions in cases of emergency situations as claimed in claim 9, wherein a resetter is used to reset the timer/pulse generator.

11. The method of operating the warning system capable of providing verbal instructions in cases of emergency situations as claimed in claim 9, wherein a number of voltage controllers are used to control voltage of any batteries which are available for operating the warning system.

12. The method of operating the warning system capable of providing verbal instructions in cases of emergency situations as claimed in claim 9, wherein the voice message that is recorded using the digital recording and the play back device is changed regularly.

13. The method of operating the warning system capable of providing verbal instructions in cases of emergency situations as claimed in claim 9, wherein the microphone is switched on and off by the recording switch.

14. The method of operating the warning system capable of providing verbal instructions in cases of emergency situations as claimed in claim 9, wherein a flashlight is used which provides a visual alarm that is activated whenever the number of speakers is activated to alert individuals of emergency situations.

* * * * *